US009120284B2

(12) United States Patent
Capoia

(10) Patent No.: US 9,120,284 B2
(45) Date of Patent: Sep. 1, 2015

(54) MACHINE FOR CUTTING AND/OR PRE-CREASING A RELATIVELY RIGID MATERIAL, SUCH AS FOR EXAMPLE CARDBOARD, A CUTTING AND/OR PRE-CREASING UNIT AND THE RELATIVE CUTTING AND/OR PRE-CREASING METHOD

(75) Inventor: Giuseppe Capoia, Cimadolmo (IT)

(73) Assignee: Panotec SRL, Cimadolmo (IT)

( * ) Notice: Subject to any disclaimer, the term of this patent is extended or adjusted under 35 U.S.C. 154(b) by 785 days.

(21) Appl. No.: 13/383,561

(22) PCT Filed: Jul. 13, 2010

(86) PCT No.: PCT/IB2010/001716

§ 371 (c)(1),
(2), (4) Date: Jan. 11, 2012

(87) PCT Pub. No.: WO2011/007237

PCT Pub. Date: Jan. 20, 2011

(65) Prior Publication Data

US 2012/0115699 A1 May 10, 2012

(30) Foreign Application Priority Data

Jul. 13, 2009 (IT) ..... UD2009A0132

(51) Int. Cl.
*B31B 1/14* (2006.01)
*B31B 1/20* (2006.01)
(Continued)

(52) U.S. Cl.
CPC ..... *B31B 1/20* (2013.01); *B26D 7/2635* (2013.01); *B31B 1/25* (2013.01); *B31F 1/10* (2013.01); *B31B 2201/147* (2013.01); *B31B 2201/257* (2013.01)

(58) Field of Classification Search
CPC .. B26D 7/2635; B26D 7/2628; B26D 7/2614; B26D 1/245; B26D 1/04; B26D 1/12
USPC ..... 493/324, 340, 396, 400, 402, 475, 476, 493/478, 355
See application file for complete search history.

(56) References Cited

U.S. PATENT DOCUMENTS 1,091,204 A * 3/1914 Ferres ..... 83/864
3,651,723 A * 3/1972 Gallagher et al. ..... 83/864
(Continued)

FOREIGN PATENT DOCUMENTS

WO 0002715 A1 1/2000
WO 2005009697 A1 2/2005

OTHER PUBLICATIONS

International Search Report dated Oct. 4, 2010 in PCT/IB2010/001716.

*Primary Examiner* — Gloria R Weeks
(74) *Attorney, Agent, or Firm* — Gifford, Krass, Sprinkle, Anderson & Citkowski, P.C.

(57) ABSTRACT

A machine for cutting and/or pre-creasing a sheet of relatively rigid material which includes movement elements to move the sheet in a defined direction of feed, a cutting and/or pre-creasing unit mobile in a direction substantially transverse to the direction of feed of the sheet, to carry out on the sheet at least a cutting and/or pre-creasing operation. The cutting and/or pre-creasing unit includes a plurality of operating heads, each one mobile transversely to the direction of feed of the sheet in an independent and autonomous manner with respect to the other operating heads, and conformed to support, move and command a single relative cutting and/or pre-creasing tool.

11 Claims, 5 Drawing Sheets

(51) Int. Cl.

| | |
|---|---|
| ***B26D 7/26*** | (2006.01) |
| ***B31B 1/25*** | (2006.01) |
| ***B31F 1/10*** | (2006.01) |

(56) References Cited

U.S. PATENT DOCUMENTS

| | | | | | |
|---|---|---|---|---|---|
| 3,929,047 | A | * | 12/1975 | Brandl | 83/499 |
| 4,109,500 | A | * | 8/1978 | Franek | 72/203 |
| 4,200,032 | A | * | 4/1980 | Roda | 493/451 |
| 4,265,437 | A | * | 5/1981 | Reist et al. | 493/435 |
| 4,285,684 | A | * | 8/1981 | Smith | 493/355 |
| 4,524,962 | A | * | 6/1985 | Davenport et al. | 270/21.1 |
| 4,846,778 | A | * | 7/1989 | Hirakawa et al. | 493/354 |
| 4,994,008 | A | | 2/1991 | Haake et al. | |
| 5,207,631 | A | * | 5/1993 | Schmidtke et al. | 493/334 |
| 5,690,601 | A | * | 11/1997 | Cummings et al. | 493/340 |
| 5,701,727 | A | * | 12/1997 | Lundstrom et al. | 53/569 |
| 5,779,617 | A | * | 7/1998 | Larkin et al. | 493/475 |
| 5,888,183 | A | * | 3/1999 | Ruthenberg et al. | 493/366 |
| 6,012,372 | A | * | 1/2000 | Laster et al. | 83/665 |
| 6,071,222 | A | * | 6/2000 | Schneider | 493/355 |
| 6,159,137 | A | * | 12/2000 | Lee et al. | 493/355 |
| 6,234,943 | B1 | | 5/2001 | Copin | |
| 6,689,037 | B2 | * | 2/2004 | Waldeck et al. | 493/355 |
| 6,729,217 | B2 | * | 5/2004 | Loewensberg | 83/332 |
| 7,303,519 | B2 | * | 12/2007 | Jenkins et al. | 493/399 |
| 7,670,275 | B2 | * | 3/2010 | Schaack | 493/403 |
| 2004/0082453 | A1 | * | 4/2004 | Pettersson | 493/180 |
| 2009/0062098 | A1 | | 3/2009 | Inoue et al. | |
| 2009/0298660 | A1 | * | 12/2009 | Schaack | 493/340 |
| 2010/0037556 | A1 | * | 2/2010 | Fresnel | 53/218 |

* cited by examiner

MACHINE FOR CUTTING AND/OR PRE-CREASING A RELATIVELY RIGID MATERIAL, SUCH AS FOR EXAMPLE CARDBOARD, A CUTTING AND/OR PRE-CREASING UNIT AND THE RELATIVE CUTTING AND/OR PRE-CREASING METHOD

CROSS-REFERENCE TO RELATED APPLICATIONS

This application is a §371 National Stage Application No. PCT/IB2010/001716, filed on 13 Jul. 2010, claiming the priority of Italian Patent Application No. UD2009A001132 filed on 13 Jul. 2009.

FIELD OF THE INVENTION

The present invention concerns a machine for working relatively rigid material. In particular, the present invention is used for cutting and/or pre-creasing paper, cardboard, plastic material or other, originally in the form of strips or sheets, in order to make containers. Here and in the following description and the claims, by the term sheet we mean, generically, both single pre-cut sheets, and also sheets arriving from rolls or strips. The present invention also concerns a cutting and/or pre-creasing unit, and the method to carry out the cutting and/or pre-creasing of the sheets.

BACKGROUND OF THE INVENTION

In the packing or packaging sector, plants are known which are used to make containers by means of a plurality of operations on a packaging material, for example a sheet of cardboard.

Known plants generally comprise a plurality of machines operatively disposed in series, and each of which is provided with a support structure substantially transverse to the direction of feed of the sheet.

One type of machine provided in such plants comprises at least a cutting and/or pre-creasing unit having a pair of operating heads, each of which supports, moves and commands both a cutting tool and a pre-creasing tool.

Solutions are known whereby the cutting and/or pre-creasing unit has tools suitable to operate both in a transverse direction to the direction of feed of the sheet, and also in a longitudinal direction to the direction of feed of the sheet.

In some cutting and/or pre-creasing conditions one and/or the other tool of each operating head can remain unused, limiting the potential productivity of the machine.

Such known plants are little suited for production in small series, and need long fitting out times to change to producing series which are different from each other.

Moreover, since in the known machines the tools are provided in pairs for each operating head, possible parallel operations distanced only a few millimeters from each other are difficult to carry out, possibly causing operational inaccuracies.

US-A-2009/0062098 discloses a creasing device for forming creases in corrugated or cardboard sheets, comprising a plurality of creasing units of the sheet, suitable for executing longitudinal creases on the sheet in a direction longitudinal with respect to the feeding direction of the sheet, and in which the distance between upper female roller and lower male roller of each creasing unit is individually adjustable. Four creasing units are movable each other along a direction transversal to the feed direction of the sheet, while a central creasing unit is disposed fixed on an upper stationary frame. Moreover, the creasing device of US'098 comprises a plurality of grooving units, disposed spaced apart one each other in a fixed manner with respect to the feeding direction and downstream of the creasing units, for executing slots on the sheet in a direction longitudinal with respect to the feeding direction of the sheet. Four grooving units are movable each other along a direction transversal to the feed direction of the sheet, while a central grooving unit is disposed fixed on a lower stationary frame.

WO-A-2005/09697 discloses a machine for manufacturing cardboard blanks from a cardboard portion including a feeding assembly for moving the cardboard portion, a first operating head disposed above the feed plane of the cardboard blank, fit to execute workings on the cardboard in a transversal direction with respect to the moving direction of the cardboard, and which is mobile in a direction orthogonal to the moving direction of cardboard portion and driven by first actuator means and second operating heads fit to execute workings on the cardboard in a longitudinal direction with respect to the moving direction of the cardboard and disposed above the feed plane of the cardboard blank, downstream the first operating head and each independently positionable by means of second actuator means in a transversal direction with respect to the machine.

Purpose of the present invention is to achieve a machine and a unit, and to perfect a method, for cutting and/or pre-creasing, which are suitable for small productions, which allow to exploit to the maximum the potential productivity of the machine and which are less bulky, more accurate and cost less.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, a machine for cutting and/or pre-creasing a sheet of relatively rigid material comprises at least movement means able to feed the sheet at least in a defined direction of feed.

The machine according to the present invention also comprises cutting and/or pre-creasing means provided with at least a cutting and/or pre-creasing unit movable in a direction substantially transverse to the direction of feed of the sheet, and able to carry out at least a cutting and/or pre-creasing operation on the sheet.

The cutting and/or pre-creasing means are disposed below a hypothetical feed plane of the sheet.

According to a variant, the machine according to the present invention can also have a printing unit.

According to a characteristic feature of the present invention, the cutting and/or pre-creasing unit comprises a plurality of operating heads, each one mobile in a direction transverse to the direction of feed of the sheet in an independent and autonomous manner with respect to the other operating heads.

Moreover, each operating head is conformed to support, move and command a single relative cutting and/or pre-creasing tool.

The present invention thus allows to dispose in an independent and autonomous manner each single tool provided, according to the operating needs of cutting and/or pre-creasing.

In this way, each cutting and/or pre-creasing operation on the sheet is managed independently from the others, increasing the possibilities of working and adjusting the position of the individual tools.

Therefore it is also possible to carry out parallel and close cutting and/or pre-creasing operations, precisely and without causing long and onerous fitting out times.

Moreover, since the individual cutting and/or pre-creasing tools are assembled on specific operation heads which are independent with respect to each other, on the same machine, different disposition patterns for the tools can be provided, so that different operations on different sheets can be carried out at the same time. In other words, with the present invention, operations that are quite different from each other can be carried out in tandem.

This possibility is particularly advantageous for small productions for which the fitting out between different series, or the acquisition of two machines, would be too heavy an investment.

According to a variant, each operating head comprises a relative movement member on board, such as an electric motor.

According to another variant, on the same machine two cutting and/or pre-creasing units according to the present invention are provided, in particular a first able to carry out cutting and/or pre-creasing operations in a direction substantially longitudinal to the direction of feed of the sheet, and a second able to carry out the cutting and/or pre-creasing operations in a direction substantially transverse to the direction of feed of the sheet.

In this way it is possible to use a single machine to carry out subsequent operations in different directions, for example in directions substantially perpendicular with respect to each other, in a completely automated manner.

According to another variant, the sheet to be cut and pre-creased is placed with the enhanced surface turned upward and the cutting and/or pre-creasing units are located below the feed plane of the sheet.

This operating condition allows to improve the operating conditions of a possible printing head, in which the possibility of impurities and residue powder being deposited is reduced to a minimum, if not substantially eliminated.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
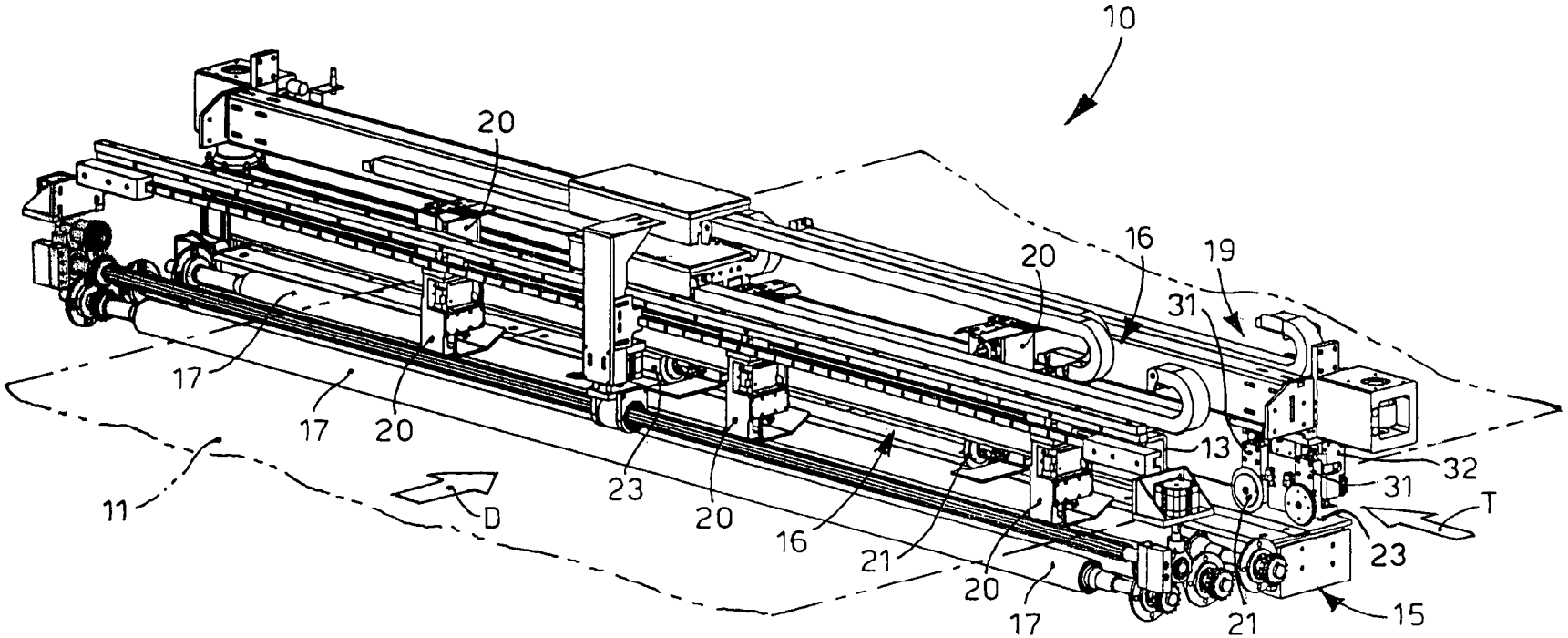
FIG. 1 is a three-dimensional view of a cutting and/or pre-creasing machine according to the present invention.
Figure 2:
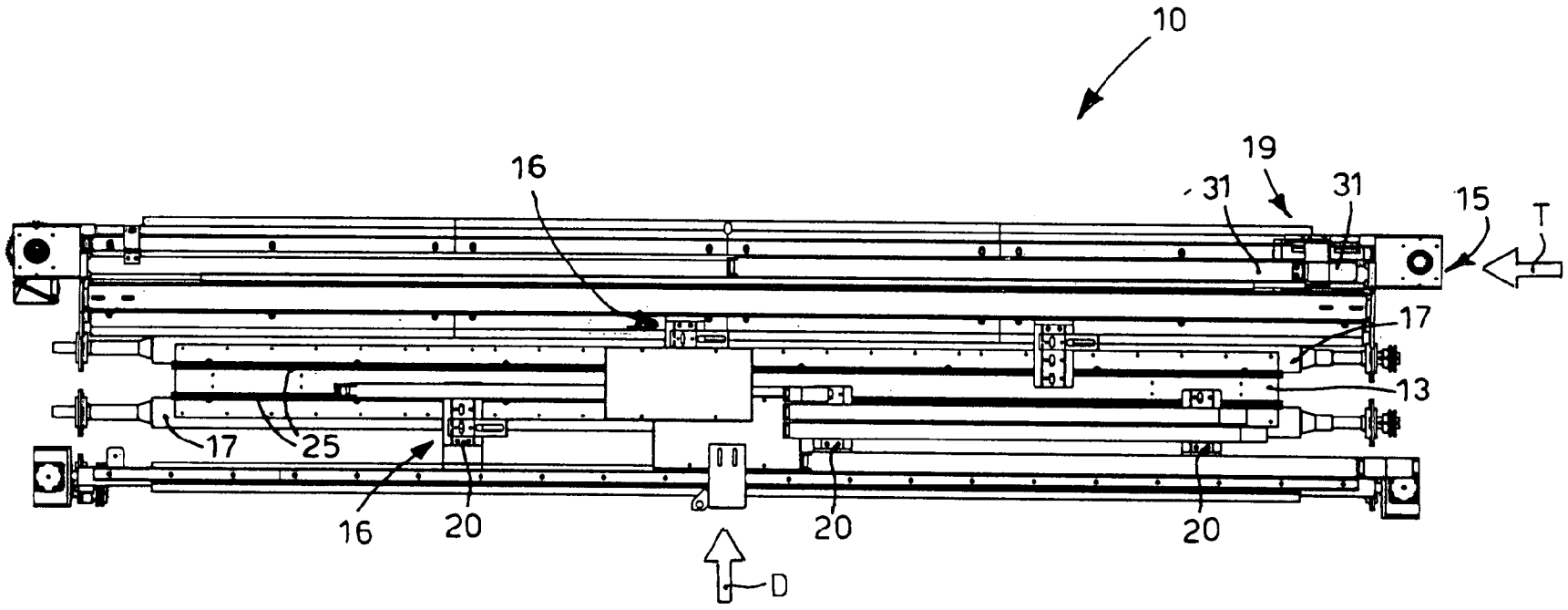
FIG. 2 shows a plane view of the machine in FIG. 1 in a possible operating step.
Figure 3:
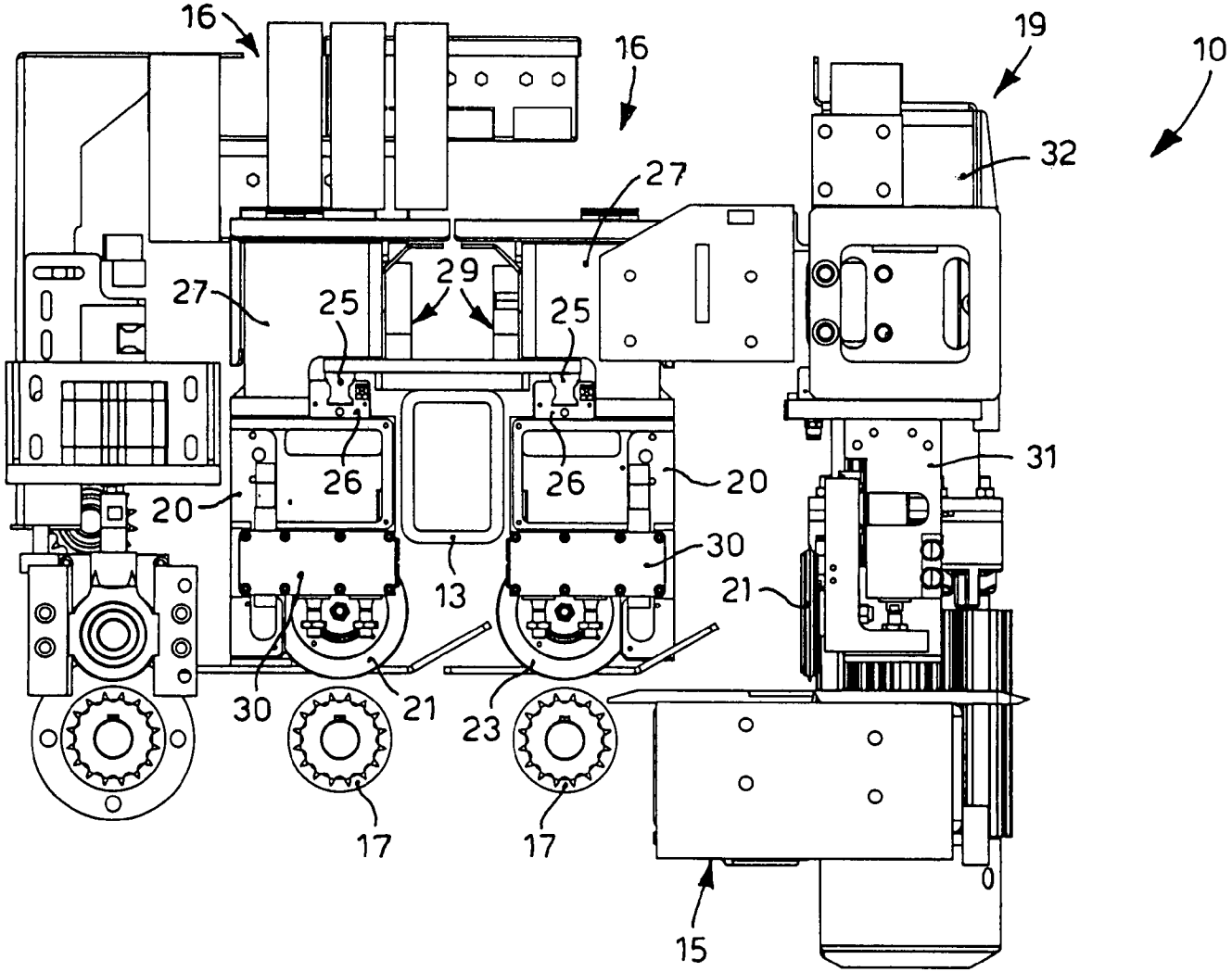
FIG. 3 shows a lateral view of an enlarged detail of the machine in FIG. 1.
Figure 4:
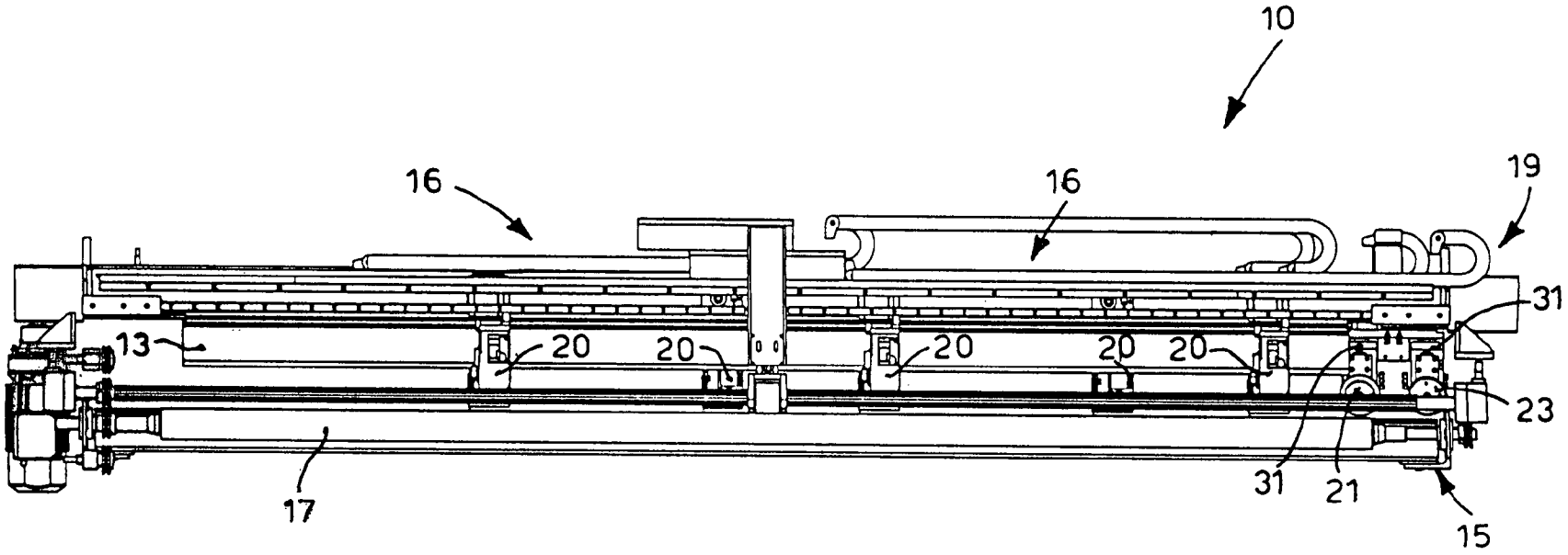
FIG. 4 shows a front view of the machine in FIG. 1.
Figure 5:
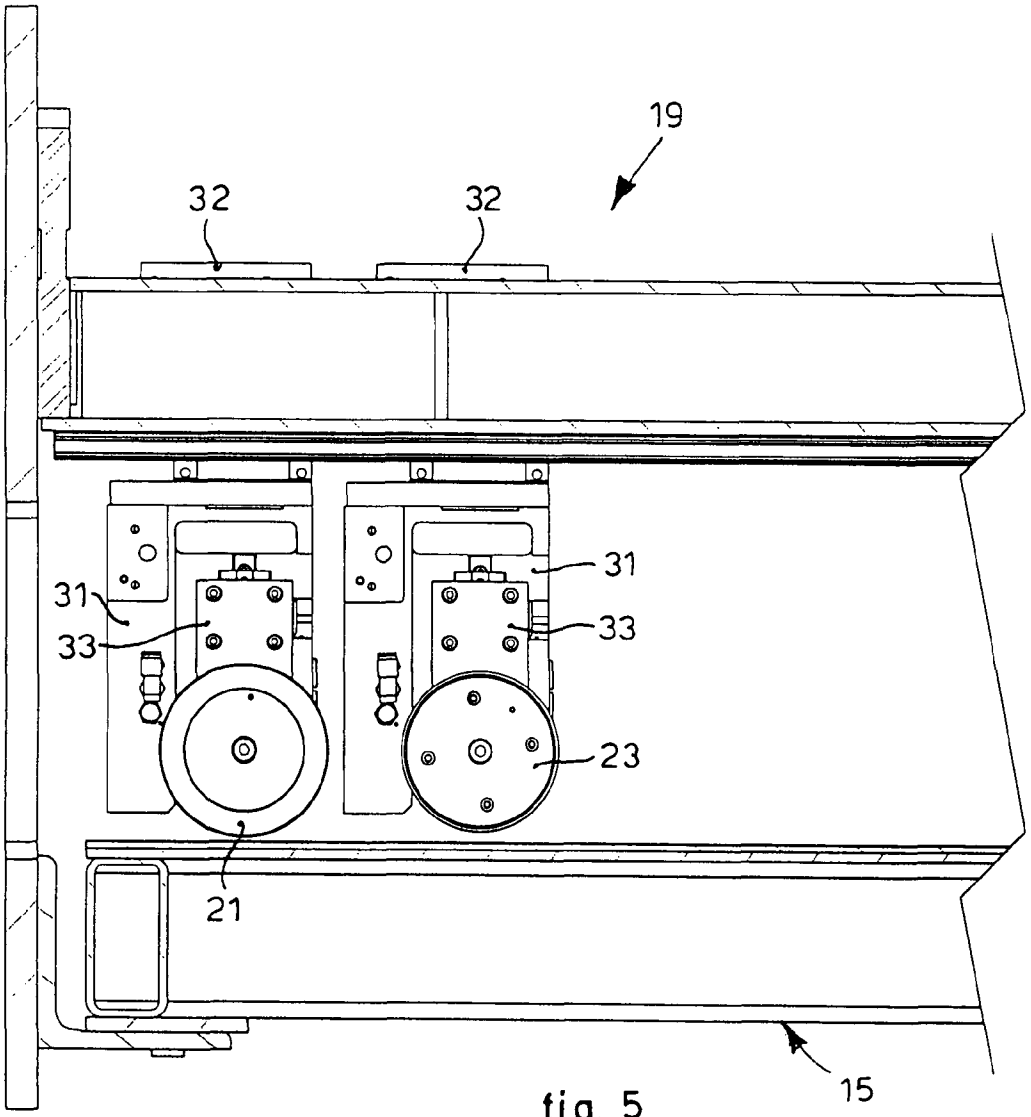
FIG. 5 shows, with a front view, an enlarged detail of FIG. 3.

With reference to the attached drawings, a machine 10 according to the present invention is used to carry out cutting and/or pre-creasing operations on a relatively rigid material, in this case a sheet 11 of cardboard, which for example can be a single sheet, a sheet of a continuous module but even a portion of a strip, a sheet coming from a pile, or two or more sheets arriving from two or more piles and fed in parallel to the machine 10.

Simply to give an example, the pre-creasing or cutting carried out on the sheet 11 of cardboard by the machine 10 is intended to promote the precise and linear folding of the cardboard, for example in the automated production steps of a packing box.

The machine 10 according to the present invention comprises a support structure 15, disposed transversely with respect to a direction of feed D of the sheets 11.

Two longitudinal cutting and/or pre-creasing units 16 are assembled on the support structure 15, disposed in sequence to each other, and a transverse cutting and/or pre-creasing unit 19 positioned downstream of the two longitudinal units 16.

To give a non-restrictive example, the machine 10 according to the present invention also comprises a feeding/introduction unit for the sheets 11 and an extraction unit with motorized roller/rollers. The latter units are of a substantially known type and are not shown in the attached drawings.

The longitudinal units 16 and the transverse unit 19 are inverted with respect to the feed plane of the sheet 11, so as to define a cutting and/or pre-creasing operation from the bottom to the top.

Each longitudinal unit 16 comprises a plurality of operating heads 20 independent from each other and mobile in a direction T to the direction of feed D of the sheet 11, along relative support beams 13 of the support structure.

In particular each operating head 20 is assembled sliding on the relative support beam 13 by means of relative linear guides 25 and sliding blocks 26.

The independent movement of each operating head 20 with respect to the relative support beam 13 is achieved by means of an electric motor 27 assembled on board the operating head 20 and kinematically connected to the support beam 13 by means of a relative pinion gear and rack 29.

Each operating head 20 is suitable to support, move and command a relative cutting tool 21, or alternatively, a relative pre-creasing tool 23.

In particular, in the longitudinal unit 16, the operating heads 20 are conformed to maintain the relative cutting tool 21 or pre-creasing tool 23 in such a way that one or other of the latter operate in a direction substantially longitudinal to the direction of feed D of the sheet 11.

Each operating head 20 also comprises a pressure member 30, kinematically connected to the cutting tool 21 or the pre-creasing tool 23, so as to determine the operating pressure of the relative tool 21 or 23, on the sheet 11, and also a condition wherein the cutting and/or pre-creasing tool 21, 23 is raised from the sheet 11.

In this way, for each cutting and/or pre-creasing operation to be carried out on the sheet 11, each individual operating head 20 is moved individually and independently of the others, in order to position the relative cutting tool 21 and/or pre-creasing tool 23 in a determinate predefined work position.

In a possible operating configuration, each longitudinal group 16 has relative operating heads 20 having, respectively, cutting tools 21 for the first longitudinal unit 16 and pre-creasing tools 23 for the second unit.

In this possible configuration of the present invention the operating heads 20 of each longitudinal unit 16 are disposed aligned with each other with respect to the direction of feed of the sheet 11, so as to be able to perform in sequence, and in an aligned manner, the necessary cutting and/or pre-creasing operations.

The transverse unit 19 comprises one or more operating heads 31, in this case too, mobile in an independent manner with respect to each other and suitable to support, move and command a relative cutting tool 21, or alternatively, a relative pre-creasing tool 23.

In particular the operating heads 31 are conformed to maintain the relative cutting tool 21 or pre-creasing tool 23 in such a way that one or the other of the latter operate in a said direction T substantially transverse to the direction of feed D of the sheet 11.

As for the operating heads 20 of the longitudinal unit 16, the movement in the transverse direction T of the operating heads 31 is achieved by means of relative electric motors 32 assembled on board the operating heads.

Moreover, each operating head 31 comprises a pressure member 33, which is kinematically connected to the cutting tool 21 or the pre-creasing tool 23, in order to determine the operating pressure of the relative tool 21 or 23, on the sheet 11, and also a condition wherein the cutting and/or pre-creasing tool 21, 23 is raised from the sheet 11.

In the same way as the operating heads 20, each individual operating head 31 is moved individually and independently from the others, in order to position the relative cutting tool 21 and/or the pre-creasing tool 23, in a determinate predefined work position.

The machine 10 also comprises a plurality of movement rollers 17 disposed on the opposite side to the longitudinal units 16 and the transverse unit 19 with respect to a hypothetical horizontal feed plane of the sheet. The movement rollers 17 determine the feed of the sheet 11 in a determinate direction of feed D in cooperation with the longitudinal units 16 and the transverse unit 19.

The movement rollers 17 also have the function of contrasting the cutting and/or pre-creasing action carried out by the tools 21 and 23.

According to a variant, the movement rollers 17 can be made both of rubber and iron, for example to carry out cutting operations on iron.

The machine 10 also comprises a control and command unit, not shown, which is electronically connected to the movement members of each operating head 20 and 31, to coordinate according to a desired operating program the positioning and drive of each single cutting tool 21 and/or pre-creasing tool 23.

It is clear, however, that modifications and/or additions of parts may be made to the machine 10, to the units 16 and 19 and to the cutting and/or pre-creasing method as described heretofore, without departing from the field and scope of the present invention.

For example, it comes within the scope of the present invention to provide that the machine 10 also comprises a printing device, not shown, disposed on the opposite side of the longitudinal units 16 and the transverse unit 19, with respect to the feed plane of the sheet 11.

According to another variant, the transverse unit 19 is not provided and downstream of the longitudinal units 16 a rotation device is provided, for example a rotating plate, able to rotate the sheet 11 by 90° and feed it in the opposite direction toward the longitudinal units 16.

According to a further variant, the machine comprises means to detect the position of the sheet 11, for example of the optical type or other, connected to the control and command unit, for example to produce an error signal.

It also comes within the scope of the present invention to provide that instead of the cutting tools 21 and/or pre-creasing tools 23, each operating head 20, 31 carries a single punching tool, such as a punch with an abutment plane/counter-mold. In this way, with the various operating heads 20, 31 individually equipped, also static operations can be carried out in order to make various drawings on the sheets 11.

It is also clear that, although the present invention has been described with reference to specific examples, a person of skill in the art shall certainly be able to achieve many other equivalent forms of machine for cutting and/or pre-creasing a relatively rigid material such as cardboard, a cutting and/or pre-creasing unit and a relative cutting and/or pre-creasing method, having the characteristics as set forth in the claims and hence all coming within the field of protection defined thereby.

The invention claimed is:

1. Machine for cutting and/or pre-creasing a sheet of relatively rigid material comprising:

movement means able to move said sheet at least in a defined direction of feed (D), cutting and/or pre-creasing means provided with cutting and/or pre-creasing units comprising a plurality of operating heads, each of said operating heads being mobile in a direction (T) substantially transverse to the direction of feed (D) of said sheet, and for carrying out on said sheet at least cutting and/or pre-creasing operations, a support structure disposed transversely with respect to the direction of feed (D) of the sheets and provided with support beams;

wherein said cutting and/or pre-creasing units are assembled on said support structure;

wherein the cutting and/or pre-creasing units are disposed below a hypothetical feed plane of the sheet and comprise at least two cutting and/or pre-creasing units, wherein at least a first said unit comprises a plurality of first operating heads for carrying out cutting and/or pre-creasing operations in a direction substantially longitudinal to the direction of feed (D) of the sheet, and wherein a second said unit comprises at least a second operating head for carrying out cutting and/or pre-creasing operations in said direction (T) substantially transverse to the direction of feed (D) of the sheet, wherein said second unit is positioned downstream of said first unit along said direction of feed (D) of the sheet;

wherein each of said operating heads is mobile in said direction (T) substantially transverse to the direction of feed (D) of the sheet in an independent and autonomous manner with respect to the other operating heads, along respective said support beams, and is conformed to support, move and command a single relative cutting and/or pre-creasing tool;

wherein each operating head is assembled sliding on the support beam by linear guides and sliding blocks; and wherein each operating head is provided with an electric motor assembled on board and kinematically connected to the support beam by a pinion gear and rack, each electric motor being configured to provide the independent movement of the respective operating head in said transverse direction (T) to the direction of feed (D) of the sheet along the respective support beam;

wherein said movement means comprises movement rollers disposed on the opposite side to said first and second units with respect to said hypothetical horizontal feed plane of the sheet, wherein said movement rollers are configured both to determine the feed of the sheet in said direction of feed (D) in cooperation with said first and second units and to contrast the cutting and/or pre-creasing action carried out by the respective cutting and/or pre-creasing tools.

2. The machine as in claim 1, wherein each operating head comprises a pressure member kinematically connected to the relative cutting and/or pre-creasing tool, to determine a determinate operating pressure of said cutting and/or pre-creasing tool on the sheet, and also a condition wherein said cutting and/or pre-creasing tool is raised from the sheet.

3. The machine as in claim 1, comprising in sequence two said first units and a said second unit.

4. The machine as in claim 1, comprising a printing unit disposed on the opposite side to at least one said cutting and/or pre-creasing unit, to print at least one surface of the sheet opposite to that on which the cutting and/or pre-creasing operations are carried out.

5. A method for cutting and/or pre-creasing a sheet of relatively rigid material comprising:

moving said sheet at least in a defined direction of feed (D), using a cutting and/or pre-creasing means provided with cutting and/or pre-creasing units comprising a plurality of operating heads, each of said operating heads being mobile in a direction (T) substantially transverse to the direction of feed (D) of said sheet to carry out at least cutting and/or pre-creasing operations on the sheet, performing cutting and/or pre-creasing operations from the bottom to the top disposing the cutting and/or pre-creasing units below a hypothetical feed plane of the sheet including:

at least a first said unit carrying out cutting and/or pre-creasing operations in a direction substantially longitudinal to the direction of feed (D) of the sheet, at least a second said unit carrying out cutting and/or pre-creasing operations in said direction (T) substantially transverse to the direction of feed (D) of the sheet, the cutting and/or pre-creasing unit provides at least a movement step in which said plurality of operating heads of the cutting and/or pre-creasing unit are moved in said direction (T) substantially transverse to the direction of feed (D) of the sheet in an independent and autonomous manner with respect to each other, each operating head supporting, moving and commanding a single relative cutting and/or pre-creasing tool, each operating head being provided with an electric motor assembled on board each electric motor providing the independent movement of the respective operating head in said transverse direction (T) to the direction of feed (D) of the sheet along a respective support beam of a support structure disposed transversely with respect to the direction of feed (D) and supporting said cutting and/or pre-creasing units wherein moving said sheet comprises using movement means comprising movement rollers disposed on the opposite side to said first and second units with respect to said hypothetical horizontal feed plane of the sheet, wherein said movement rollers feed the sheet in said direction of feed (D) in cooperation with said first and second units and contrast the cutting and/or pre-creasing action carried out by the respective cutting and/or pre-creasing tools.

6. The method of claim 5, wherein said electric motor is kinematically connected to a fixed support structure by a relative pinion gear and rack.

7. The method of claim 5, wherein each operating head comprises a pressure member kinematically connected to the relative cutting and/or pre-creasing tool, which determines a determinate operating pressure of said cutting and/or pre-creasing tool on the sheet, and also a condition wherein said cutting and/or pre-creasing tool is raised from the sheet.

8. The method of claim 5, comprising in sequence two said first units and a said second unit.

9. The method of claim 5, comprising a printing unit disposed on the opposite side to the at least one said cutting and/or pre-creasing unit, which prints at least one surface of the sheet opposite to that on which the cutting and/or pre-creasing operations are carried out.

10. Machine for cutting and/or pre-creasing a sheet of relatively rigid material comprising:

movement means able to move said sheet at least in a defined direction of feed (D), cutting and/or pre-creasing means provided with one or more cutting and/or pre-creasing units comprising a plurality of operating heads, each of said operating heads being mobile in a direction (T) substantially transverse to the direction of feed (D) of said sheet, and for carrying out on said sheet at least cutting and/or pre-creasing operations, a support structure disposed transversely with respect to the direction of feed (D) of the sheets and provided with support beams;

wherein said cutting and/or pre-creasing units are assembled on said support structure;

wherein the cutting and/or pre-creasing units are disposed below a hypothetical feed plane of the sheet and comprise at least two cutting and/or pre-creasing units, wherein at least a first said unit comprises a plurality of first operating heads for carrying out cutting and/or pre-creasing operations in a direction substantially longitudinal to the direction of feed (D) of the sheet, wherein a rotation device is provided, downstream of said first unit along said direction of feed (D) of the sheet, said rotation device being configured to rotate the sheet by 90° and feed the rotated sheet in a direction opposite to said direction of feed (D) toward said first unit;

wherein each of said operating heads is mobile in said direction (T) substantially transverse to the direction of feed (D) of the sheet in an independent and autonomous manner with respect to the other operating heads, along respective said support beams, and is conformed to support, move and command a single relative cutting and/or pre-creasing tool;

wherein each operating head is assembled sliding on the support beam by linear guides and sliding blocks;

wherein each operating head is provided with an electric motor assembled on board and kinematically connected to the support beam by a pinion gear and rack, each electric motor being configured to provide the independent movement of the respective operating head in said transverse direction (T) to the direction of feed (D) of the sheet along the respective support beam;

wherein said movement means comprises movement rollers disposed on the opposite side to said first unit with respect to said hypothetical horizontal feed plane of the sheet, wherein said movement rollers are configured both to determine the feed of the sheet in said direction of feed (D) in cooperation with said first unit and to contrast the cutting and/or pre-creasing action carried out by the respective cutting and/or pre-creasing tools.

11. A method for cutting and/or pre-creasing a sheet of relatively rigid material comprising:

moving said sheet at least in a defined direction of feed (D), using a cutting and/or pre-creasing means provided with cutting and/or pre-creasing units comprising a plurality of operating heads, each of said operating heads being mobile in a direction (T) substantially transverse to the direction of feed (D) of said sheet to carry out at least cutting and/or pre-creasing operations on the sheet, performing cutting and/or pre-creasing operations from the bottom to the top disposing the cutting and/or pre-creasing units below a hypothetical feed plane of the sheet including: at least a first said unit carrying out cutting and/or pre-creasing operations in a direction substantially longitudinal to the direction of feed (D) of the sheet, rotating the sheet by 90° downstream of said first unit along said direction of feed (D) after said first said unit carrying out cutting and/or pre-creasing operations in a direction substantially longitudinal to the direction of feed (D) of the sheet and feeding the rotated sheet in a direction opposite to said direction of feed (D) toward said first unit, the cutting and/or pre-creasing unit provides at least a movement step in which said plurality of operating heads of the cutting and/or pre-creasing unit are moved in said direction (T) substantially transverse to the direction of feed (D) of the sheet in an independent and autonomous manner with respect to each other, each operating head supporting, moving and commanding a single relative cutting and/or pre-creasing tool, each operating head being provided with an electric motor assembled on board, each electric motor providing the independent movement of the respective operating head in said transverse direction (T) to the direction of feed (D) of the sheet along a respective support beam of a support structure disposed transversely with respect to the direction of feed (D) and supporting said cutting and/or pre-creasing units;

wherein moving said sheet comprises using movement means comprising movement rollers disposed on the opposite side to said first unit with respect to said hypothetical horizontal feed plane of the sheet, wherein said movement rollers feed the sheet in said direction of feed (D) in cooperation with said first unit and contrast the cutting and/or pre-creasing action carried out by the respective cutting and/or pre-creasing tools.

* * * * *